US005129395A

United States Patent [19]

Hoffmann

[11] Patent Number: 5,129,395

[45] Date of Patent: Jul. 14, 1992

[54] SHOE INTERIOR

[76] Inventor: John A. Hoffmann, P.O. Box 18, Virginia, Minn. 55792

[21] Appl. No.: 646,465

[22] Filed: Jan. 25, 1991

Related U.S. Application Data

[63] Continuation of Ser. No. 395,532, Aug. 18, 1989, abandoned.

[51] Int. Cl.[5] ..... A43B 7/14

[52] U.S. Cl. ..... 36/145; 36/166

[58] Field of Search ..... 128/581, 586, 595, 596, 128/607, 610, 614, 615, 617, 619, 621, 622, 80 D; 36/43, 71

[56] References Cited

U.S. PATENT DOCUMENTS

| | | | |
|---|---|---|---|
| 532,429 | 1/1895 | Rogers | 128/581 X |
| 1,370,799 | 3/1921 | Egerton | 128/595 |
| 1,481,133 | 1/1924 | Grossman | 128/621 |
| 1,614,934 | 1/1927 | Saums | 128/621 X |
| 1,634,816 | 7/1927 | Allen | 128/621 |
| 1,673,126 | 6/1928 | Sarra . | |
| 1,675,578 | 7/1928 | Scholl | 128/586 X |
| 1,685,155 | 9/1928 | Emeott | 128/596 X |
| 1,757,904 | 5/1930 | Free | 128/595 X |
| 1,867,431 | 7/1932 | Wood | 128/586 |
| 2,084,455 | 6/1937 | Reed | 128/586 X |
| 2,088,707 | 8/1937 | King | 128/622 |
| 2,475,417 | 7/1949 | Wysowski . | |
| 2,581,864 | 1/1952 | Kaufmann, Jr. | 128/614 X |
| 3,265,071 | 8/1966 | Kirchner et al. . | |
| 3,997,984 | 12/1976 | Hayward . | |
| 4,262,433 | 4/1981 | Hagg et al. . | |
| 4,316,333 | 2/1982 | Rothschild . | |
| 4,408,402 | 10/1983 | Looney . | |
| 4,517,981 | 5/1985 | Santopietro et al. | 128/581 |
| 4,627,177 | 12/1986 | Meyers . | |
| 4,633,877 | 1/1987 | Pendergast | 128/581 |
| 4,715,131 | 12/1987 | Kremendahl | 128/595 X |

FOREIGN PATENT DOCUMENTS

| | | | |
|---|---|---|---|
| 588504 | 12/1959 | Canada | 128/617 |
| 191671 | 9/1937 | Switzerland | 128/607 |

OTHER PUBLICATIONS

Pamphlet of Wizard Lightfoot Appliance Company, *Orthopraxy of the Foot,* 1921; pp. 22–23.

*Primary Examiner*—Richard J. Apley
*Assistant Examiner*—Linda C. M. Dvorak
*Attorney, Agent, or Firm*—Dickinson, Wright, Moon, Van Dusen & Freeman

[57] ABSTRACT

An insert for a shoe or a shoe interior comprises a central portion which prevents excess pronation, a front portion which extends arcuately and transversely across the foot to support the transverse metatarsal arch, a rear portion which extends transversely across the foot and contacts the forward edge of the heel, a lateral, slanted edge which is aligned parallel to the longitudinal axis of the arch and support the fifth metatarsal shaft of the foot, and a fourth portion which slopes medially. The device is designed to fit the area of void on the plantar side of the human foot to support the structure of the foot to prevent excess pronation and to substantially reduce foot morbidity.

9 Claims, 3 Drawing Sheets

SHOE INTERIOR

This application is a continuation of Ser. No. 395,532, filed Aug. 18, 1989, now abandoned.

TECHNICAL FIELD

This invention relates to the art of podiatric medicine. In a particular embodiment, the invention relates to the interior of a shoe.

BACKGROUND ART

The human foot is bio-mechanically extremely complex and is anatomically quite sophisticated. The foot must absorb forces which during sports or other rigorous activities can apply forces to the foot which are four to five times the original body weight. It has been reported that 75%-80% of the people in the United States have some form of foot morbidity. These people are usually in moderate to severe pain, and a variety of treatments have been used.

Because most people wear shoes, efficient transfer of forces from the foot to the ground through the shoe is critical.

Anatomically, the bottom (plantar) surface of the human foot can be divided into four areas. These are, the rear or heel area, the mid-foot or arch area, the metatarsophalangeal joint or ball area, and the toes. The foot basically shows three plantar bony prominences which are the first metatarsal head, the fifth metatarsal head, and the heel. These are joined by a strong skin which traverses the concave area generally referred to as the "arch". This "arch" is the medial longitudinal arch, and the foot also comprises a lateral longitudinal arch which projects forward from just in front of the heel and a transverse metatarsal arch which extends from one side of the foot to the other in the ball area of the foot.

The human gait has been analyzed in some detail, and the ground-contact, or stance phase is generally considered to comprise four parts. These are the heel strike, the fore-foot loading, the heel lift, and the toe off. Proper foot functioning results in a smooth flow of forces from the body to the shoe and the ground throughout the entire phase.

When moving from heel strike to forefoot loading, the foot unlocks it's arch components and depresses to absorb shock and to adjust for uneven terrain. If the arch depresses excessively, propulsion, which carries the highest vertical force, will be initiated from an unlocked structure which will subject it to injury, such as a strain or a sprain. The biomechanical principle involved is that an unstable bone will not support weight but will instead be placed in motion by the forces acting on it. In addition, progressive deformities may result.

The arch depressing stage is referred to as "pronation." Many factors may cause pronation to excess, such as a high arch in a flexible foot, a hard walking surface, excessive weight, extremely tight calf muscles or poorly designed shoes. Many physicians believe that abnormal pronation of the foot is the most common cause of foot pathology today.

Many techniques have been proposed to treat problems with the foot in one way or another. U.S. Pat. No. 2,475,417 (Wysowski) teaches a triangular pad having a front part which extends directly from a location under the metatarsal bone of the large toe to a position at the other side of the foot under the metatarsal bone of the little toe. The third corner of the pad is substantially at the center of the foot U.S. Pat. No. 1,673,126 (Sarra) also teaches a triangular pad for fitting in the arch of a foot.

U.S. Pat. No. 3,265,071 (Kirchner et al) teaches an orthopedic pad which fits only in a small region of the arch of a foot.

U.S. Pat. No. 3,997,984 (Hayward) teaches a canvas shoe having a raised portion in the sole which fits in the arch of the foot.

U.S. Pat. No. 4,316,333 (Rothchild) teaches removable foot support devices which fit in a variety of locations of a shoe.

U.S. Pat. No. 4,408,402 (Looney) shows a shoe also having an arch support, and U.S. Pat. No. 4,627,177 (Meyers) shows an insole having support which extends from the longitudinal arch to the heel.

SUMMARY OF THE INVENTION

None of the prior art devices fully addresses the problem of excessive pronation adequately. Accordingly, foot pain is still experienced even when inserts such as these are used.

In accordance with the invention, an insert or interior for a shoe comprises a rear portion which contacts the plantar surface of the foot at the rearmost portion of the longitudinal arch. This stabilizes the heel from side to side and at least partially supports the inclined heel bone in a direction from the back of the foot to the front of the foot. This support prevents the aversion of the heel bone and prevents premature loading of the foot on the medial side, which would exaggerate unwanted depression. A central portion of the insert according to the invention is elevated above a base for restricting internal plantar excursion. The central portion is contiguous with the rear portion. A forward portion is also contiguous with the central portion and slopes forward from the central portion to terminate in a curved front edge for engaging the transverse metatarsal arch of the foot. A second portion is contiguous with the central portion and slopes laterally to terminate in a straight edge which is either closely adjacent or engages the fifth metatarsal of the foot. A third portion slopes medially from the central portion and terminates in a convex edge closely adjacent or engaging the head of the first metatarsal and the medial edge of the longitudinal arch of the foot.

The front ridge of the convex portion of the inventive device fits the metatarsophalangeal joint area to maintain metatarsal head spacing and reduce front-to-back sliding friction at the metatarsophalangeal joint. This also helps stabilize the proximal phalanx against the metatarsal head, providing the toes with the proper propulsive position. The support provided by the inventive device, decreases friction and micro-trauma to the common digital nerves passing between the metatarsal heads, and irritation to joint capsules and tendons which causes pain and inflammation of the lumbricales which in turn initiates contraction deformities of the digits. This contraction wastes energy of the flexor digitorum longus muscle because it causes buckling of the toes rather than the propulsion that it should. The device of the invention conserves energy by preventing excessive pronation and properly initiates relocking of the foot, thus stabilizing the elements of the foot against each other and the ground. After heel lift the device of the invention allows a smooth flow of the forces from the mid-foot to the fore-foot which also reduces trauma and irritation to the ball area of the foot.

The inventive device also supports the first metatarsal shaft while allowing the first metatarsal head to maintain ground contact and facilitate proper rotation of the foot against the ground. This also provides more efficient propulsion and helps minimize mechanical jamming at the first metatarsophalangeal joint.

Applicant has found that materials having the density of piano felt are ideal for the device according to the invention.

While the device of the invention is often referred to herein as an insert, it is to be understood that it is within the contemplation of the invention to design the supportive device as a part of a shoe.

It is an object of this invention to provide an article which supports the foot so as to prevent excessive pronation.

DETAILED DESCRIPTION OF THE PREFERRED EMBODIMENT

Figure 1:
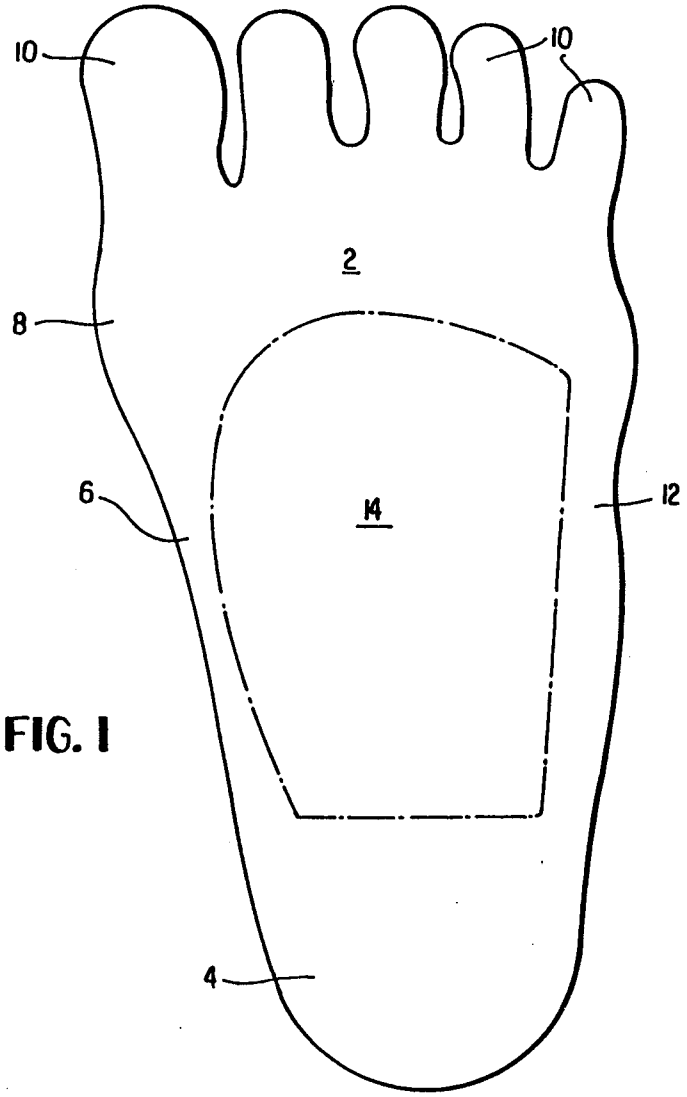
FIG. 1 is a bottom view of a human right foot illustrating a void area.

With reference to FIG. 1, the bottom of a human foot 2 comprises a heel portion 4, a mid-foot or arch area 6, a ball area 8, toes 10, and a lateral portion 12. An area 14 which is encompassed by these other areas generally comprises a void which allows the foot to pronate during the contact and mid-stance divisions of the human gait.

Figure 2:
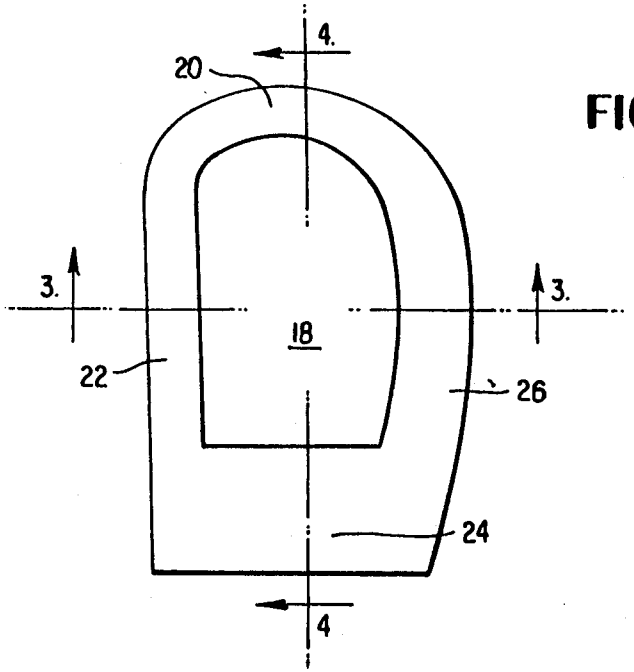
FIG. 2 is a top view of a device in accordance with the invention.

FIG. 2 is a plan view of a device in accordance with the invention for use on a left human foot, the foot shown in FIG. 1 being a right foot.

Figure 3:
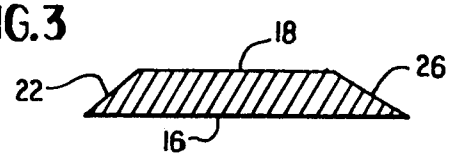
FIG. 3 is a cross-section taken along line 3—3 of FIG. 2.
Figure 4:
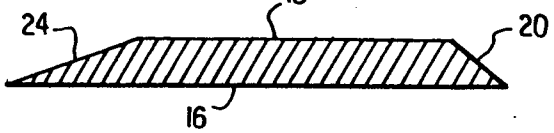
FIG. 4 is a cross-section taken along line 4—4 of FIG. 2.

With reference to FIGS. 2–4, the device comprises a base 16 which would ordinarily be in contact with a lower, internal surface of a shoe. A central portion 18 is elevated above the base and restricts internal plantar excursion. A front convex portion 20 fits the ball area and stabilizes the proximal phalanges against the metatarsal heads giving the toes proper propulsive power. Thus, the curved front edge 20 engages the transverse metatarsal arch of the foot. A portion 22 slopes laterally from the central portion and terminates in a generally straight edge designed to be closely adjacent or to engage the fifth metatarsal of the foot. The horizontal extent of portion 22 is preferably about 5/8 in. A rear portion 24 is longer (e.g. a horizontal extent of about 1.5 in.) and more gently sloped than front portion 20 and extends transversely to efficiently contact the forward edge of the heel as it extends upward and forward. A medial portion 26 includes a moderately sloping edge that connects the forward convex portion 20 to the rear portion 24. Medial portion 26 terminates in a convex edge which is closely adjacent or engages the head of the first metatarsal and the medial edge of the longitudinal arch of the foot.

The central portion may be 0.125 to 0.375 inch above the base 16, and is preferably about 0.25 inch above the base. The horizontal extent of the portion 20 may be between 1.1 and 1.3, and is preferably 1.2 times the horizontal extent of the lateral portion 22. The horizontal extent of the medial portion of 26 may be between 1.3 and 1.5, and is preferably 1.4 times that of the second portion 22. The horizontal extent of the fourth portion 24 may be 1.8 to 2.2, and is preferably 2.0, times the horizontal extent of the first portion 20.

Because the central portion is generally flat, the ratio of the slope of one portion to the slope of another portion is the inverse of the ratio of the horizontal extent of the one portion to the horizontal extent of the other portion.

Figure 5:
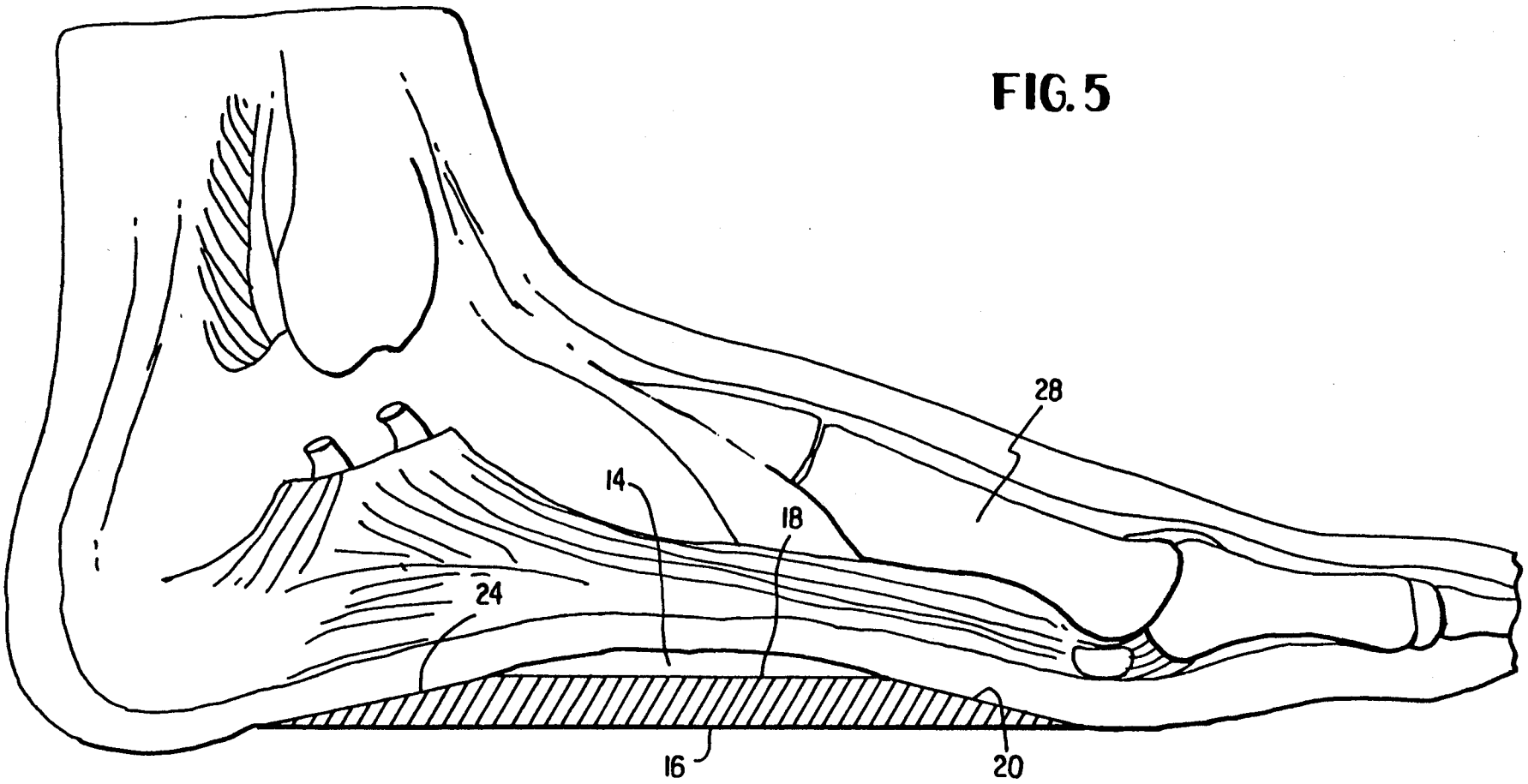
FIG. 5 is a side-view of a human foot showing a device in accordance with the invention in longitudinal cross-section and illustrating some internal structure of the foot.

FIG. 5 is a side view of a human foot showing some of the internal structure of the foot and a longitudinal cross section of a device in accordance with the invention. The central portion 18 does not completely fill the void 14 to allow the foot room for pronation while preventing excessive pronation. This reduces stress on all the plantar muscles and initiates a reversal of the pronation phase to the relocking for, propulsion. This also stabilizes the gasseous components against each other and the ground.

The front convex portion 20 lies under the first metatarsal 28 and terminates adjacent the ball of the foot. This provides support for the first metatarsal which prevents migration of the first ray dorsally which can cause mechanical jamming at the first metatarsophalangeal joint and early pain and arthritis. The rear portion 24 extends upward and forward to accept contact with the forward edge of the heel.

Figure 6:
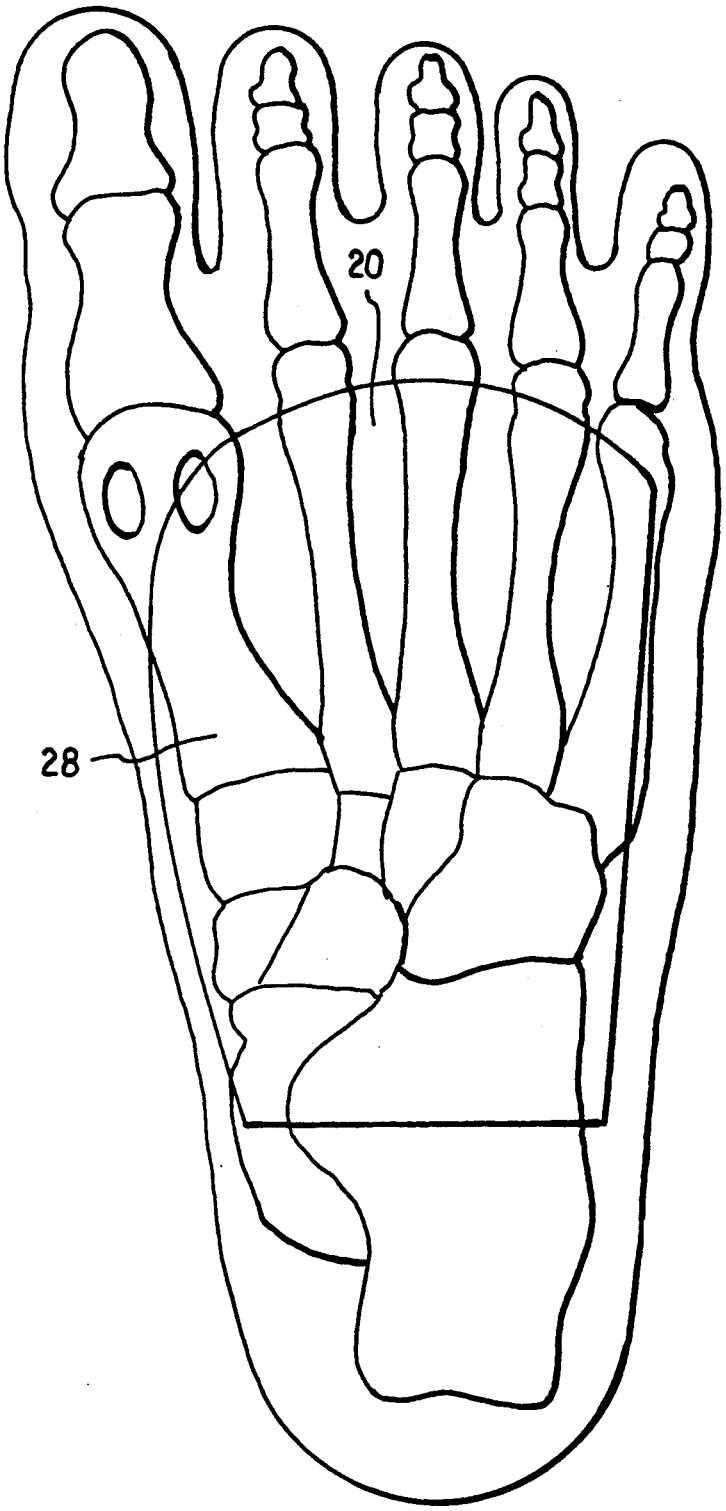
FIG. 6 is a bottom-view of a human foot showing the device of the invention in phantom lines and illustrating the bone structure of the foot.

FIG. 6 is a bottom view of a human right foot and shows the relationship between the device of the invention and the bones of the foot as set forth above.

The length of the central portion 18 (FIG. 5) is preferably about 60% of the overall length of the device. In a practical embodiment, an overall length of about 5.25 inch has been found useful for an average size foot.

It will be appreciated that an ergonomically designed shoe interior has been described having a shape which will provide a better anatomical fit and therefore improved biomechanical function yielding a more efficient flow of forces from the foot to the shoe. This efficient flow imposes a stop on excessive foot depression and thereby relieves stress and pain.

Modifications within the scope of the appended claims will be apparent to those of skill in the art.

I claim:

1. Apparatus for prevention of excessive pronation of a human foot comprising a base, a central portion elevated above said base for restricting internal plantar excursion, a first portion contiguous with and sloping forward from said central portion and terminating in a curved front edge for engaging the transverse metatarsal arch of said foot, a second portion contiguous with and sloping laterally from said central portion and terminating in a generally straight edge closely adjacent or engaging the fifth metatarsal of said foot, a third portion contiguous with and sloping medially from said central portion and terminating in a convex edge closely adjacent or engaging the head of the first metatarsal and extending along substantially the complete medial edge of the longitudinal arch of said foot, and a fourth portion contiguous with and sloping rearward from said central portion and terminating in an edge closely adjacent or engaging the forward edge of the heel of said foot.

2. Apparatus according to claim 1 wherein said central portion is about 0.125 to 0.375 inch above said base.

3. Apparatus according to claim 1 wherein said central portion is about 0.25 inch above said base.

4. Apparatus according to claim 1 wherein the slope of said first portion is between 0.91 and 0.77 times that of said second portion, the slope of said third portion is between 0.77 and 0.67 times that of said second portion, and the slope of said fourth portion is between 0.56 and 0.45 times that of said first portion.

5. Apparatus according to claim 4 wherein the slope of said first portion is about 0.83 times that of said second portion, the slope of said third portion is about 0.71 times that of said second portion, and the slope of said fourth portion is about one-half that of said second portion.

6. Apparatus according to claim 4 wherein the length of said central portion is about 0.6 times the overall length of said apparatus.

7. Apparatus according to claim 4 wherein said central portion is substantially flat.

8. Apparatus according to claim 4 made of a material having the density of piano felt.

9. Apparatus according to claim 8 made of piano felt.

* * * * *

UNITED STATES PATENT AND TRADEMARK OFFICE

CERTIFICATE OF CORRECTION

PATENT NO. : 5,129,395

DATED : July 14, 1992

INVENTOR(S) : John A. Hoffmann

It is certified that error appears in the above-identified patent and that said Letters Patent is hereby corrected as shown below:

Column 3, line 20, "right" should be --left--;
line 32, --left-- should be inserted before "foot";
lines 45 and 46, ", the foot shown in FIG. 1 being a right foot" should be deleted;
Column 4, line 37, "right" should be --left--.

Signed and Sealed this

Second Day of November, 1993

Bruce Lehman

*Attest:*

BRUCE LEHMAN

*Attesting Officer*

*Commissioner of Patents and Trademarks*